US007174673B2

(12) United States Patent
Sanke et al.

(10) Patent No.: US 7,174,673 B2
(45) Date of Patent: Feb. 13, 2007

(54) JACK-SHAFT OPERATOR ASSEMBLY HAVING CONNECTING PLATE SECURED BY A COUPLER TO A DRIVE MEMBER

(75) Inventors: Michael Sanke, Rheda-Wiedenbrück (DE); Viktor Schütz, Arnsberg (DE)

(73) Assignee: Hormann KG Antriebstechnik, Steinhagen (DE)

( * ) Notice: Subject to any disclaimer, the term of this patent is extended or adjusted under 35 U.S.C. 154(b) by 164 days.

(21) Appl. No.: 10/719,326

(22) Filed: Nov. 24, 2003

(65) Prior Publication Data

US 2004/0139654 A1 Jul. 22, 2004

(30) Foreign Application Priority Data

Nov. 29, 2002 (DE) ..... 102 55 881
Dec. 19, 2002 (DE) ..... 102 59 771

(51) Int. Cl.
*E05F 15/16* (2006.01)

(52) U.S. Cl. ..... 49/199; 160/188; 49/200

(58) Field of Classification Search ..... 49/199, 49/200; 403/337, 383; 160/191, 188, 310; 464/182

See application file for complete search history.

(56) References Cited

U.S. PATENT DOCUMENTS 2,870,616 A * 1/1959 Benson ..... 464/99
3,703,071 A * 11/1972 Anderson ..... 56/295
4,878,529 A * 11/1989 Hormann ..... 160/201
4,976,168 A * 12/1990 Lotznicker et al. ..... 74/625
5,865,235 A * 2/1999 Krupke et al. ..... 160/191
6,134,835 A * 10/2000 Krupke et al. ..... 49/200
6,401,792 B1 * 6/2002 Mullet et al. ..... 160/188
6,408,925 B1 * 6/2002 Dorma ..... 160/191
6,568,454 B1 * 5/2003 Mullet et al. ..... 160/188
6,735,905 B1 * 5/2004 Miller ..... 49/200
6,959,751 B2 * 11/2005 Savard et al. ..... 160/315
2005/0109473 A1 * 5/2005 Bresson ..... 160/191

FOREIGN PATENT DOCUMENTS

EP 0651123 A1 5/1995
EP 0651123 B1 5/1995

* cited by examiner

*Primary Examiner*—Gregory J. Strimbu
(74) *Attorney, Agent, or Firm*—Stevens, Davis, Miller & Mosher, LLP

(57) ABSTRACT

A shaft operator assembly for moving a door assembly which includes a movable door leaf and a door shaft attached to the door leaf for common movement together. A shaft connecting unit includes a shaft connecting element and a connecting plate element and connects a driven member of the shaft operator assembly with minimal space requirements to the door shaft. The connecting plate element, which can be secured to or integrally configured with the driven member, is relatively thin to permit the jack shaft operator and connecting plate element to be shifted into a fitted position even where little space is available. The shaft connecting element is mountable non-rotatably on the door shaft and includes an axial opening extending through the shaft connecting element for receiving the door shaft.

18 Claims, 3 Drawing Sheets

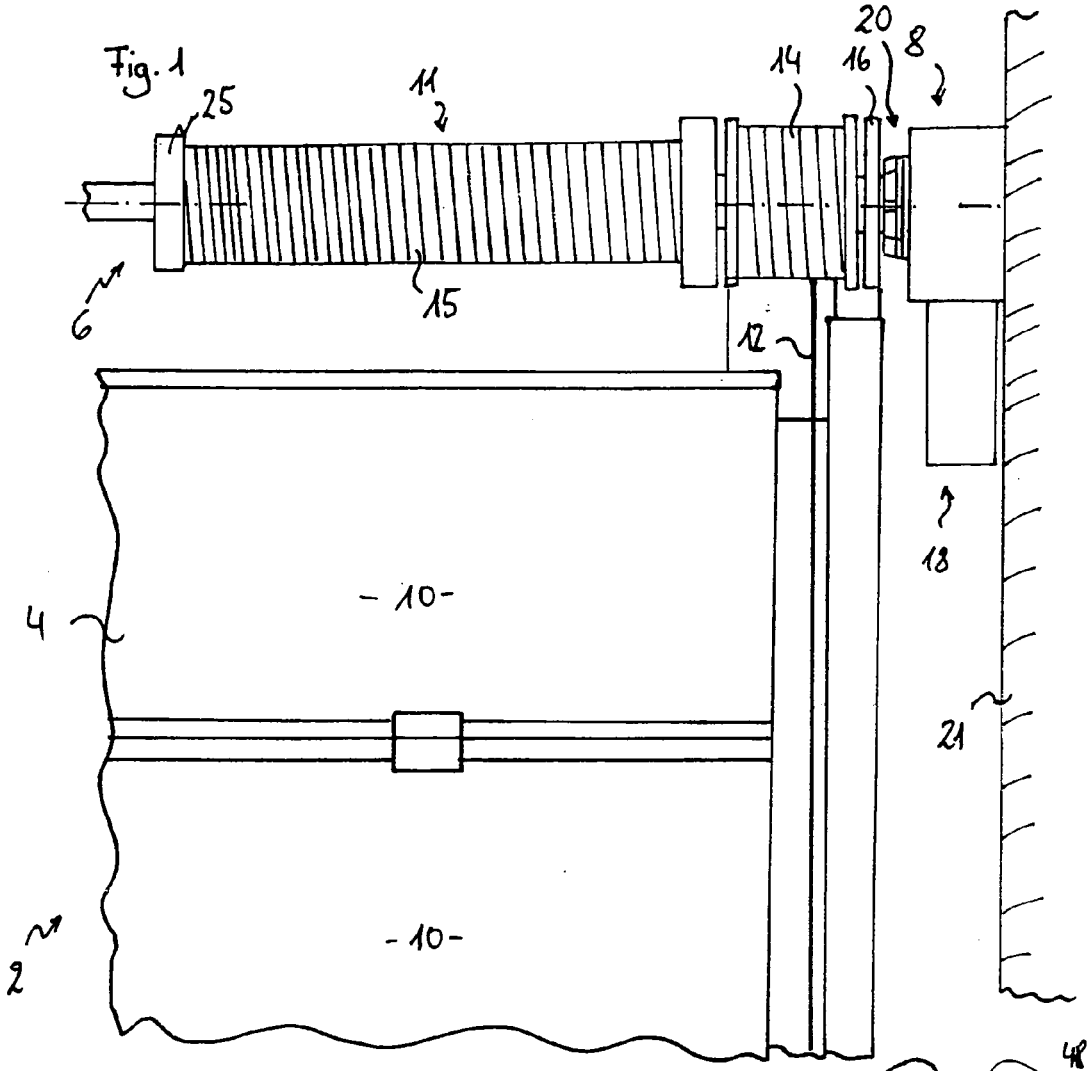
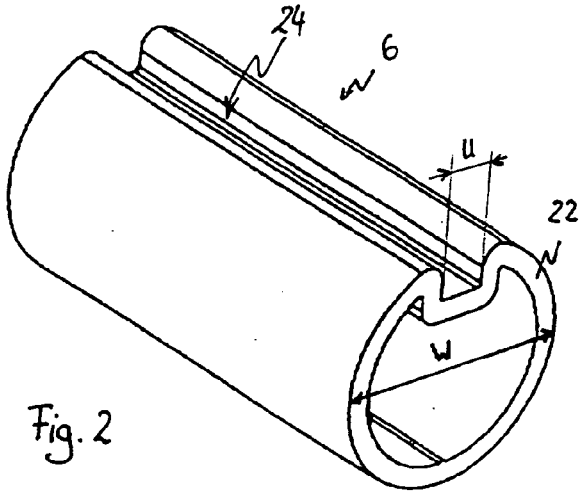
Fig. 2
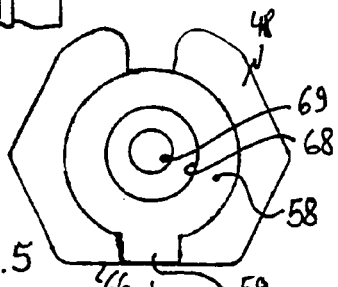
Fig. 5
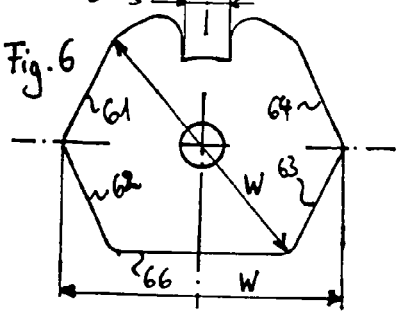
Fig. 6

JACK-SHAFT OPERATOR ASSEMBLY HAVING CONNECTING PLATE SECURED BY A COUPLER TO A DRIVE MEMBER

FIELD OF THE INVENTION

The invention relates to a jack-shaft operator assembly for powering a door comprising a movable door leaf and a drive tube or door shaft geared to the door leaf for common movement thereof, including a shaft connecting means for connecting a driven member of the jack-shaft operator assembly to the door shaft or drive tube. Such jack-shaft operators are commercially available for motorized door operation. In addition, the invention relates to a door provided with such a jack-shaft operator assembly as well as to a method for fitting such a jack-shaft operator assembly.

PRIOR ART

Some commercially available doors feature in addition to a movable door leaf also a drive tube or door shaft. Such a door shaft may be part of a means for counterbalancing a door to be moved vertically at least in part. In such a case, the drive tube or door shaft is connected to a torsion spring. The drive tube or door shaft is geared to the door leaf, for example via a lift cable or the like so that movement of the door leaf moves the drive tube or door shaft. Such doors have been on the market for a long time.

Likewise available on the market are direct or jack-shaft operators for powering such doors. These jack-shaft operators are connected directly to the door shaft or drive tube, i.e. the operator driving the door shaft or drive tube rotatingly. This rotation of the door shaft causes movement of the door leaf geared thereto. Accordingly, jack-shaft operators of this type make use of gearing already available on the door side, thus eliminating the need for additional gearing as required on other door operators, for instance on trolley-type systems. This is why such jack-shaft operators are of advantage as regards the labor and expense involved in production and assembly.

Jack-shaft operators available on the market are composed of a usually electric operator motor and a reduction gear, the reduction gear mostly featuring a worm gear. This kind of gearing is self-locking and the reason why jack-shaft operators as compared to trolley-type operators also feature better security against forced entry.

It has since been discovered in many applications that doors already provided with a door shaft or drive tube nevertheless need to be fitted with a trolley-type operator. The reason for this is the usually cramped space available in the surroundings of the door. It is particularly with doors to basement car parks, that to the left and right of the door only little—too little—sideroom is available to additionally mount a jack-shaft operator on the drive tube.

SUMMARY OF THE INVENTION

The invention is based on the object of configuring a jack-shaft operator assembly of the kind as cited at the outset such that it can now be put to use even where little space is available.

This object is achieved on the basis of a jack-shaft operator assembly of the kind as cited at the outset in that the shaft connecting means now comprises a connecting plate element secured to or integrally configured with the driven member and a shaft connecting element mountable non-rotatably, more particularly positively non-rotatably, on the door shaft or drive tube, the shaft connecting element including an axial opening extending through the shaft connecting element for receiving non-rotatably, more particularly positively non-rotatably, the door shaft and connectable or connected by a plate connecting portion located radial outside of the opening to the connecting plate element.

Fitting a jack-shaft operator apparatus may make even a centimeter or a few millimeters critical. The lack of a few millimeter space makes it necessary to decide whether additional gearing needs to be employed or even a change made to a totally different type of door operator. As compared to known jack-shaft operators a few centimeters can now be saved in accordance with the invention by the door shaft or drive tube being fully insertable into the tube connecting element. Now, between the drive tube and a casing accommodating the driven member merely the particularly thin configurable connecting plate element is provided, serving to transmit the torque to the tube connecting element.

The invention eliminates couplings located axially between the drive tube and a drive shaft serving as the driven member. Joining the tube connecting element to the connecting plate element is now achieved radially outside of the opening receiving the drive tube so that the drive tube itself can axially extend up to the connecting plate element.

Separating the system into a (connecting) plate element and a shaft connecting element is of advantage since this now makes it possible to initially fit only the plate element to the jack-shaft operator. The tube connecting element can be mounted on the door shaft or drive tube separately therefrom. Since the plate element is very thin (e.g. approx. 10 mm in one version) the jack-shaft operator including the connecting plate element fitted thereto can be shifted into the fitted position transversely to the axial direction of the door shaft or drive tube.

This surprisingly simple solution makes the jack-shaft operator apparatus in accordance with the invention compatible with a great many doors, formerly necessitating recourse having to be made to other types of door operator.

Advantageous aspects of the invention read from the dependent claims. An advantageous use as well as a method for fitting the jack-shaft operator assembly in accordance with the invention reads from the further independent claims.

The shaft connecting element and the connecting plate element may be combined in an integral, substantially pot-shaped component. For example, such a pot-shaped component itself could be put to use as the driven member of the jack-shaft operator assembly.

Preferably, however, the connecting plate element is a thin connecting plate configured separately from the tube connecting element, which is of advantage to production. Apart from this, when configured separately, a variety of tube connecting elements can be fitted to one and the same connecting plate, resulting in a wealth of handy sizes and shapes of the drive tube.

For reliable torque transmission preferably all components of the tube connecting means positively engage the adjoining component in each case. The opening in the tube connecting element is preferably configured to receive the door shaft positively non-rotatably. The plate connecting portion and the connecting plate preferably interengage positively and are further preferably connectable to each other, for example by cap screws or the like, to prevent axial displacement. The connecting plate is preferably connected to the driven member positively non-rotatably or configured integral therewith.

The positive engagement of the plate connecting portion with the connecting plate is achieved in one preferred embodiment by at least one axial protuberance and/or an axial recess in the plate connecting portion with a complementary configured structure at the connecting plate.

In fitting the jack-shaft operator as explained above with the connecting plate already mounted and pushing the jack-shaft operator into the fitted position, the door shaft needs to be shifted relative to the jack-shaft operator only by the axial extent of the protuberance/recess. In one embodiment the axial extent of the recess in the connecting plate for receiving the dog-like or claw-like protuberance amounts to roughly half the thickness of the connecting plate. For example, for a roughly 10 mm thick plate dog-like or claw-like protuberances extend 5 mm in the direction of the connecting plate. More end float for fitting the door operator is not needed, whilst nevertheless achieving a reliable positive connection for transmission of the rotary motion.

To permit adapting the jack-shaft operator assembly as regards its axial position relative to the drive tube to the constructional requirements of the site, it is provided for that the tube connecting element is shiftably mounted on the drive tube. Any unwanted axial displacement of the tube connecting element relative to the drive tube can then be prevented by friction contact. For this purpose the tube connecting element comprises, for example, a tapped hole extending radially for receiving a locking cap screw.

Many doors on the market are provided with a door shaft provided full-length with an axial extending slot in the outer circumference. In accordance therewith it is preferred when the inner axial receiving opening of the shaft connecting element comprises a radial protuberance extending inwardly for positively connecting an axial slot arranged in the contour of the door shaft.

To accommodate other shaft or tube contours or sizes as well, a set of assorted shaft connecting elements is preferably available.

The driven member is preferably formed by a hollow shaft fully accommodated in a gearcase. The inner portion of the hollow shaft can then be used as the power takeoff. This hollow shaft or quill shaft may also pass through the gearcase totally, i.e. for access on both sides of the gearcase. Such a configuration permits optionally fitting the jack-shaft operator assembly to the left or right end of the drive tube or door shaft with no additional complication.

The connecting plate could integrally comprise a mating pin for connecting it to the hollow shaft. Production is then simplified when the connecting plate is non-rotatably secured to the driven member via an intermediate member or adapter which could also be termed a screw- or lock-type member or adapter and which is termed coupler hereinafter. Thus, simply making the attachment with the coupler dispenses with space needed for further fastening means. One advantageous means of fastening the coupler and connecting plate is achieved by the coupler clasping the connecting plate and positively engaging a recess at the side of the connecting plate opposite the driven member. Then, simply by locking the coupler in the direction of the driven member the connecting plate can be locked to the driven member. Once the clasping portion of the coupler is fully home in the receiving recess of the connecting plate, hardly any sideroom is needed for securing the connecting plate.

Locking the connecting plate to the coupler also permits drawing the connecting plate on the hollow shaft such that a friction contact materializes between an axial end surface area of the hollow shaft and the axial surface area of the connecting plate facing the hollow shaft. This friction contact enhances torque transmission from the hollow shaft to the connecting plate. In one example aspect this thus achieves both a positive and non-positive connection between the hollow shaft and connecting plate. The positive connection is made via a first positive connection of the coupler and hollow shaft and a second positive connection between the coupler and the connecting plate. The friction contact is made via flat mating of axial surface areas of the connecting plate and hollow shaft.

The coupler is preferably provided with a flanged portion protruding radial circumferentially outwards from a member of the coupler forming an engaging portion at its one axial end. Such a flanged portion may be configured to extend less axially and more radially to thus permit transmisssion of high torque by engaging the corresponding contoured receiving recess in the connecting plate despite sideroom being saved. The engaging portion of the coupler may be configured substantially cylindrical and contoured outwards complementary to the inner contour of the quill shaft acting as the driven member. In one example the engaging portion is keyed to a slot in the quill shaft.

This keyed connection or other positive connection between the coupler and quill or hollow shaft is preferred where high torque transmission is needed, as in the case of industrial doors, for example. On smaller doors, such as, for instance, sectional garage doors the torque transmission requirement is very much less. In this case, the aforementioned friction contact achieved by locking the connecting plate to the hollow shaft may fully suffice for reliable torque transmission, in thus dispensing with expensive keyed or similar positive connection designs and accordingly saving on production costs.

Another advantage of locking the connecting plate element to the driven member is preventing tilting. Since the plate element is shrink fitted, it is maintained positioned perpendicular to the axial direction. Fastening is done preferably also by an axial central locking cap screw, resulting in locking being affected purely by axial forces. This eliminates unbalance and lop-sided biasing of the connecting plate, in thus preventing wobbling when the connecting plate element is connected to the driven member. Preventing tilting is of particular advantage with such drive tubes. Heavy torsion springs are usually fitted thereto, tending to cause the drive tube to bend. In practice it is often the case that drive tubes run out of round, all the more so, the longer their service. A connecting plate precisely aligned radially helps to support the drive tube in reducing wear induced by it running out of round.

Whilst the flanged portion itself preferably engages the connecting plate non-rotatably, it can, however, suffer axially displacement relative to the latter. Preventing this axial displacement is done by bracing the coupler to the driven member, resulting in the connecting plate being braced or locked in place between the flanged portion and the driven member or a mount on the gearcase.

The flanged portion may be contoured in various ways for configuring a positive engagement with the recess configured complementary in the connecting plate element. Conceivable, among other things, is a square, splined, star-shaped or octagonal profile. One type of outer contour of the flanged portion preferred for reasons of facilitated fabrication is formed by a modified hexagonal profile. Each corner of the hexagon is preferably spaced away from the longitudinal centerline of the coupler, coinciding with the axis of rotation, just sufficiently so that it can pass through the opening for receiving the drive tube in the tube connecting element. At least four of the edges of the outer circumference take the form of a regular hexagon which makes for facilitated gripping, for example, by a fork wrench or the like. Of the remaining two edges, one simulates the contour of a portion of the opening of the tube connecting element which is defined for positively engaging the drive tube. The remaining edge is flatter than the four other straight edges, but likewise configured straight and preferably finishing flush with an axial extending protuberance at the engaging portion. It is this protuberance at the engaging portion that serves as the tongue of a tongue and groove connection between the quill shaft acting as the driven member and the engaging portion of the coupler.

The form of the coupler as described has the advantage that, after assembly of the connecting plate and the tube connecting element, the coupler permits insertion through the receiving opening of the tube connecting element into the mating position. In this arrangement the portion of the receiving opening of the tube connecting element configured for positive attachment of the drive tube guides the coupler on insertion.

Bracing the coupler is preferably done by means of a cap screw extending centrally axial in the driven member. This cap screw extends preferably transversely through the driven member configured as quill or hollow shaft and is counter-located at the opposite end of the driven member by means of a kind of washer. This allows the coupler to be drawn by the cap screw axially in the direction of the driven member to thus brace the connecting plate between the driven member and the flanged portion of the coupler.

In another preferred aspect a set of assorted connecting plates differing in size is available to permit fitting a variety of tube connecting elements. Each of the connecting plates of this assortment is configured the same as regards the portion engaged by the coupler so that one and the same coupler can be used for the various connecting plates.

The material preferred for the connecting plate and the tube connecting element is zinc die-cast.

Further sideroom can be saved by arranging the driven member on a gearcase which features a recess for receiving the connecting plate element arranged on the driven member at least in part.

Thus saving sideroom in the embodiment of the invention as most preferred is achieved by torque transmission via a flat plate to a plate connecting portion arranged radially outside of the door shaft or drive tube, securing this connecting plate via a recessed portion clasping the rear side of the connecting plate as well as locking the connecting plate in the direction of the driven member to draw the connecting plate as near as possible to the gearcase, partly receiving the connecting plate in the gearcase and configuring the opening full-length in the shaft connecting element. On top of this, in a further preferred embodiment, the coupler is provided with a central axial tapped hole for bracing it so that no screw caps or the like protrude at the side of the door shaft.

At the opposite side of the driven member configured as quill or hollow shaft the bracing cap screw is mounted on a washer in the form of a dished washer. The dished configuration of this washer results in the cap of the screw not protruding from the gearcase despite the edge of the dish contacting the end of the hollow shaft. The gearcase is shaped preferably cuboidal, the narrowest side of which is located parallel to the longitudinal centerline of the driven member. Protruding from one side of the gearcase is an operator motor housing. All units fitted to the gearcase are arranged on this motor side and protrude on no side from the gearcase, this applying also to a coupling lever via which the door shaft can be disconnected from the operator to permit manual movement in an emergency.

A door provided with the shaft operator assembly (also called direct operator) in accordance with the invention can thus be installed even in a cramped space location of a building or fencing entry zone. For fitting the shaft operator assembly the procedure is preferably to first secure the connecting plate element and shaft connecting element to the driven member before the jack-shaft operator assembly with the shaft connecting element is mounted on the drive tube. Where necessary, the door shaft is not fitted with the mounted jack-shaft operator assembly until on site, the jack-shaft operator assembly then being secured in situ, i.e. it is not until the relative axial position of the jack-shaft operator assembly and the drive tube has been defined in situ that the tube connecting element and the drive tube are bolted in place to prevent axial displacement.

When sufficient sideroom is available alongside the door shaft, fitting the connecting plate element and the shaft connecting element to the driven member is preferably done by first securing the connecting plate employed as the connecting plate element to the tube connecting element. This is done preferably by mating the two positively to ensure reliable torque transmission. Cap screws are used to secure the two elements axially in place. The resulting unit is then locked to the driven member by means of the coupler. For this purpose the coupler, due to the special configuration of its flanged portion, can be inserted through the receiving opening of the tube connecting element into its rear clasping position by inserting the engaging portion through a corresponding opening in the connecting plate, after which the connecting element formed by the tube connecting element and the connecting plate element is locked to the driven member.

When, however, only little sideroom is available, the procedures as described above of separately securing the connecting plate element, on the one hand, to the jack-shaft operator assembly and, on the other, the shaft connecting element to the door shaft, inserting the jack-shaft operator assembly at the axial end of the door shaft and subsequently securing the two elements to each other and to the door operator are all implemented in situ.

BRIEF DESCRIPTION OF THE DRAWINGS

An example embodiment of the invention will now be described in detail with reference to the attached drawing in which:

FIG. 1 is a view, partly broken away, from inside of an upper corner of a garage door showing a door shaft or drive tube and a jack-shaft operator or direct operator;

FIG. 2 is a partial view in perspective of the door shaft;

FIG. 5 is an axial side view of a portion for inserting a coupler of the shaft connecting means;

FIG. 6 is a side view of the coupler as shown in FIG. 5 as seen from the opposite side;

FIG. 7*a* is a rear view of a connecting plate of the shaft connecting means;

FIG. 7*b* is a side view of the connecting plate as shown in FIG. 7*a*.

DETAILED DESCRIPTION

Figure 3:
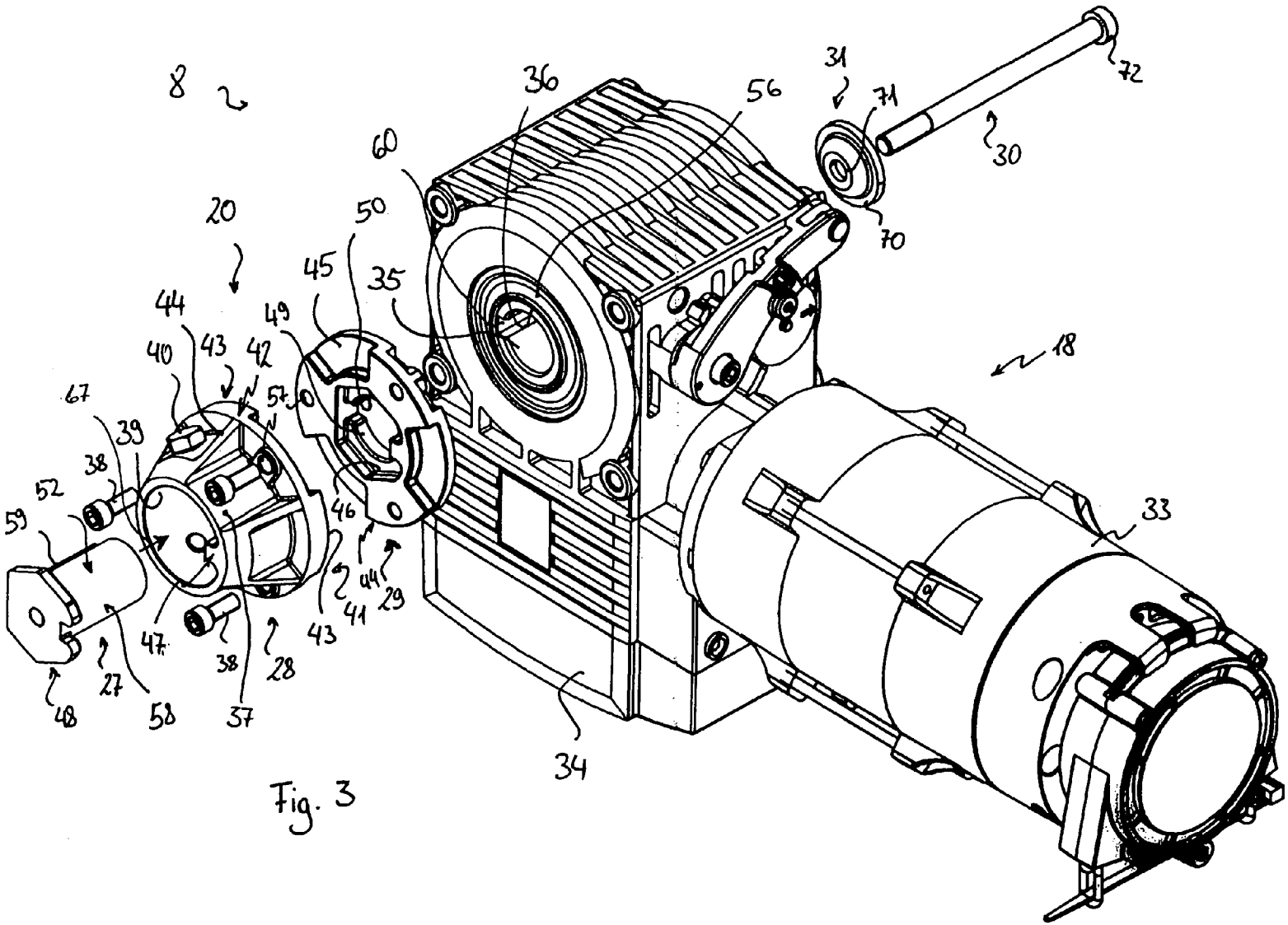
FIG. 3 is an exploded view in perspective of a shaft connecting means on a jack-shaft operator.

Referring now to FIG. 1 there is illustrated a door 2 comprising a door leaf 4 and a door shaft (also called drive tube) 6 as well as a jack-shaft operator assembly 8.

In the example as shown the door 2 is a sectional door comprising a plurality of panels 10 hinged to each other. The door leaf 4 made up of the panels 10 moves, in its opening movement, from a vertical closed position upwards into a horizontal opened position. The door shaft 6 is part of a counterbalancing system 11 for compensating the weight of the door leaf. The door shaft 6 is geared via a traction means, in this case in the form of a traction cable 12 for winding on a cable drum 14, to the door leaf 4 such that every movement of the door leaf 4 results in movement of the door shaft 6. Mounted on the door shaft 6 is a torsion spring 15. The door shaft 6 is secured in place at both ends via a mounting element 16, for example to a frame (not shown) of the door 2. The door shaft 6 protrudes at both ends from the mounting element 16. At one of the protruding ends the jack-shaft operator assembly 8 is directly mounted on the end of the door shaft 6.

The jack-shaft operator assembly 8 comprises a jack-shaft operator 18 and a shaft connecting means 20. The shaft connecting means 20 connects the jack-shaft operator to the door shaft 6. The jack-shaft operator assembly 8 is inserted between the mounting element 16 and the adjoining wall 21.

Referring now to FIG. 2 there is illustrated a view of the door shaft 6 in perspective. The door shaft 6 is formed substantially by a tube 22 provided full-length with an axial slot 24. The tube 22 has an outer diameter W. The slot 24 has an inner width U. The slot 24 serves to positively connect the tube 22 non-rotatably to the connecting elements, such as, for example, a spring washer 25 of the torsion spring 15, the cable drum 14 or the tube connecting means 20.

Referring now to FIG. 3 there is illustrated the shaft connecting means 20 which will now be described in more detail.

The shaft connecting means 20 has a coupler 27, a shaft connecting element 28, a connecting plate element in the form of a connecting plate 29, a locking cap screw 30 and a washer 31 for the latter.

The jack-shaft operator has an electric motor accommodated in an operator housing 33 and a reduction gear, more particularly a worm gear (not shown) accommodated in a gearcase 34. The gearing transmits the torque generated by the operator motor to a driven member 35 accommodated in the gearcase 34.

The visible part of the driven member 35 in this case is configured as a quill shaft or hollow shaft 36. The hollow shaft 36 may be formed by the inner stub of a driven worm shaft. The hollow shaft 36 extends transversely through the gearcase 34. At the rear side (not shown in FIG. 3) the gearcase is configured just the same as the axial front side as shown in FIG. 3.

In the example as shown in this case the shaft connecting element 28 and the connecting plate 29 are configured as separate items for positively connecting matingly via cap screws 38. The shaft connecting element 28 has outwards substantially the shape of a truncated cone, it featuring a through opening 39 serving to receive the door shaft 6. A protuberance 47 protruding radially inwards serves to engage the slot 24. The protuberance 47 has a width which is only slightly less than the inner width U so that the door shaft 6 is positively received non-rotatably in the opening 39. By means of a bracing cap screw 40 inserted in a radial tapped hole, the door shaft 6 can be located in an arrangement as selected axially with the shaft connecting element 28. At the axial end 41 the larger diameters, the shaft connecting element 28 is provided radially outside of the opening 39 with a plate connecting portion 42. The plate connecting portion 42 is formed substantially by a radial protruding annular plate-shaped portion.

From this annular plate-shaped portion three protuberances 43 protrude axially. Conically tapered lands 44 connect the plate connecting portion 42 to a substantially tubular shaft receiving portion 37 in reinforcing the latter.

Figures 4, 8:
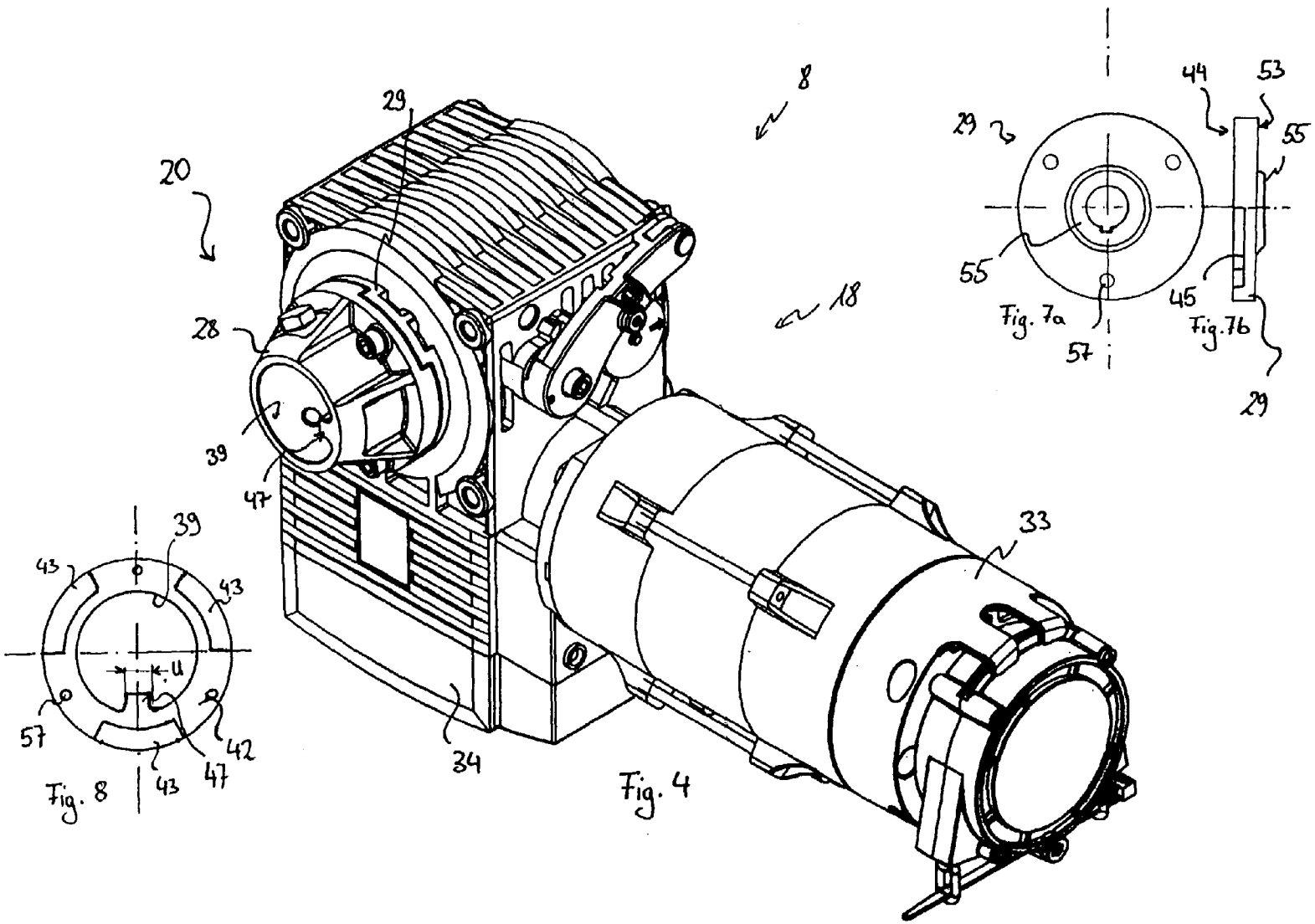
FIG. 4 is a view as shown in FIG. 3 with the shaft connecting means fitted to the jack-shaft operator.
FIG. 8 is a rear view of an axial end of a shaft connecting element of the shaft connecting means.

Referring now to FIG. 8 there is illustrated a plan view of the axial end 41 to face the connecting plate 29, clearly indicating the plate portion of the plate connecting portion 42 axial withdrawn relative to the protuberances 43 and the protuberances 43. Also evident is how the opening 39 is axial throughout.

Referring now to FIG. 3, as well as to FIGS. 7*a* and 7*b* there is illustrated the connecting plate 29 in more detail, it being substantially circular in circumference. Provided at the outer circumferential portion on a side 44 of the connecting plate 29 to face the tube connecting element 28 are three recesses 45 for positively receiving the protuberances 43. A central recess 46 serves to positively receive a flanged portion 48 of the coupler 27. The central recess 46 extends only up to roughly half the axial thickness of the connecting plate 29. Provided at the bottom of the central recess 46 is a wall 49 defining a central through hole 50. The contour of the central through hole 50 is adapted to receive an engaging portion 52 of the coupler 27 such that it is positively insertable through the central through hole 50 into the hollow shaft 36.

The contour of the central recess 49 is configured like the contour of the flanged portion 48 to which detailled reference is made further on. The depth of the central recess 49 corresponds to the width of the flanged portion 48. The flange portion 48 can thus be fully received in the central recess 49 in contacting the central through hole 50. At the side 53 of the connecting plate 29 to face the gearcase 34 the central through hole 50 is defined by an axial protruding annular protuberance 55. The free end of the annular protuberance 55 is configured to contact the one axial end of the quill shaft 36 of the driven member 35.

When assembled, the annular protuberance 55 engages an annular recess 56 of the gearcase 34 surrounding the hollow shaft 36. Three tapped holes 57 each in the shaft connecting element 28 and connecting plate 29 serve to receive one cap screw 38 each for connecting these two elements 28, 29.

Referring now to FIG. 3 as well as to FIGS. 5 and 6 there is illustrated the coupler 27 in more detail, it comprising substantially a tubular body 58 forming the engaging portion 52 provided with an axial protuberance 59 and the flanged portion 48 at one end. The axial protuberance serves to engage a corresponding groove 60 in the hollow shaft 36 in thus positively locating the coupler 27 non-rotatably with the driven member 35 by a tongue and groove connection.

Referring now to FIG. 6 there is illustrated how the flanged portion has a modified hexagonal form. Four of the edges are configured as flats 61–64. Each of the corners of the flanged portion 48 defining these flats 61–64 has a radial spacing away from the longitudinal centerline corresponding to half the diameter W of the drive tube.

This permits the flanged portion 48 to be inserted through the opening 39 snugly adapted to the diameter W of the drive tube whilst nevertheless having the maximum possible radial extent for facilitated torque transmission. Each of the four flats 61–64 is thus likewise equispaced from the longitudinal centerline by the centerpoint in each case. These may also serve for application of a tool.

In the example embodiment as shown in this case a fifth edge 65 mimics the contour of the door shaft 6 surrounding the slot 24, or, to put it better, is adapted to the complete structure of the opening 39 of the shaft connecting element 28 in the region surrounding the protuberance 47 (see FIG. 8).

When fitting the coupler 27 as indicated in FIG. 3 (see arrow 67) this edge portion 65 serves to guide the coupler 27 such that it matches insertion into the central through hole 50 and central recess 46. The other flat flat 66 by contrast is configured flat for flush contact with the protuberance 59, whilst being configured longer than the flat 64. Although the corners defining the flat 66 also have a radial spacing of 0.5×W, since the flat 66 is configured longer, however, its centerpoint lies closer to the longitudinal centerline than the centerpoints of the flats 61–64.

The tubular body 58 is provided over most of the end facing away from the flanged portion with a blind hole 68. Communicating the bottom of the blind hole 68 to the other end is a through tapped hole 69 in which the locking cap screw 30 mates.

Again as evident from FIG. 3 the bracing cap screw 30 is supported by its cap 72 on the bracing cap screw washer 31 which is provided with an edge portion 70 for support at the other axial end of the hollow shaft 36 whilst featuring a dished central portion 71 for nesting the screw cap 72 so that it does not protrude from the gearcase 34.

Referring now to FIG. 4 there is illustrated the jack-shaft operator assembly 8 assembled. Assembling the shaft connecting means 20 is done such that the shaft connecting element 28 and the connecting plate 29 are bolted together into a unit which is then locked to the hollow shaft 36 by means of the coupler 27 inserted through the opening 39 before being bolted by the bracing cap screw 30 and its washer 31.

Fitting the jack-shaft operator assembly 8 to the door shaft 6 is done by mounting the jack-shaft operator assembly 8 in the arrangement as shown in FIG. 4 on the door shaft 6. The configuration of the shaft connecting element 28 and connecting plate 29 is designed to ensure that the door shaft 6 can be inserted totally up to the connecting plate 29 through the shaft connecting element 28 in thus saving sideroom.

In other words, the shaft connecting element as described in this case features a domed connector (shaft connecting element 28) which is connected to the gearing via an intermediate plate (connecting plate 29) and a follower (coupler 27). The follower extends into the driven shaft 36 of the worm gear in slaving the rotation thereto and is braced at the other side by means of a cap screw 30 and its washer 31.

After having bolted the domed connector 28 in place the door shaft 6 can be connected to this domed connector protruding directly into the gearing in thus saving sideroom between the gearing and the door shaft 6 to be connected. The connecting plate 29 for the domed connector employed as the shaft connecting element 28 and the latter itself are made of zinc die-cast, whilst the coupler or follower 27 is made of steel.

Proceeding as described above results in a tighter axial assignment of the transmission block and the drive tube to be powered thereby.

What is claimed is:

1. A shaft operator assembly for moving a door having a movable door leaf and a door shaft attached to said door leaf for common movement together, said shaft operator assembly comprising a shaft connecting means for connecting a driven member of said shaft operator assembly to said door shaft, wherein said shaft connecting means comprises a connecting plate element secured to said driven member and a shaft connecting element mountable non-rotatably on said door shaft, said shaft connecting element including an axial opening extending through said shaft connecting element for receiving non-rotatably said door shaft and including a plate connecting portion located radially outside of said opening and mounted to said connecting plate element;

wherein said connecting plate element is a flat connecting plate separate from said shaft connecting element;

said connecting plate element is secured non-rotatably and braced to said driven member by a coupler;

wherein said coupler comprises a cylindrically shaped portion and a flanged portion having side surfaces, said flanged portion is in positive engagement with said connecting plate element in a non-rotatable but axially movable manner relative thereto; and wherein said connecting plate element is clasped to said driven member by said coupler and includes on a side opposite said driven member a receiving access for facing said door shaft, wherein the side surfaces of the flanged portion of said coupler are fully received in said receiving access and non-rotatably engage corresponding surfaces of said receiving access.

2. The shaft operator assembly as set forth in claim 1, wherein said plate connecting portion comprises one of an axial protuberance and an axial recess, and wherein said connecting plate element has a structure comprising connecting portion, corresponding with one of an axial recess for receiving said axial protuberance of said plate connecting portion and a axial protruding portion for engaging said axial recess of said plate connecting portion so that said plate connecting portion and said connecting plate element interlock.

3. The shaft operator assembly as set forth in claim 1, wherein said driven member is arranged in a gearcase having a recess therein for receiving at least in part said connecting plate element arranged on said driven member.

4. The shaft operator assembly as set forth in claim 1, wherein said shaft connecting element is shiftably mountable on said door shaft and lockable in place thereon by positive friction action against the door shaft.

5. The shaft operator assembly as set forth in claim 4, wherein said shaft connecting element comprises a radial tapped hole for receiving a clamping cap screw for locking said shaft connecting element to said door shaft.

6. The shaft operator assembly as set forth in claim 1, wherein a slot of said door shaft is adapted to be arranged in the axial opening of said shaft connecting element.

7. The shaft operator assembly as set forth in claim 1, wherein said driven member comprises one of a quill shaft and a hollow shaft totally housed in a gearcase.

8. The shaft operator assembly as set forth in claim 7, wherein said coupler comprises an engaging portion positively engaging non-rotatably said one of a quill shaft and a hollow shaft.

9. The shaft operator assembly as set forth in claim 1, wherein the coupler solely secures and braces said connecting plate element non-rotatably to said driven member.

10. The shaft operator assembly as set forth in claim 1, wherein said connecting plate element is secured to said driven element by a cap screw extending centrally axial in said driven member.

11. The shaft operator assembly as set forth in claim 10, wherein said coupler is secured to said driven element by said cap screw extending centrally axial in said driven member in.

12. The shaft operator assembly as set forth in claim 1, wherein said connecting plate element and said shaft connecting element are made of zinc die-cast metal.

13. A shaft operator assembly as set forth in claim 1, wherein said shaft connecting element is connected to said door shaft.

14. A shaft operator assembly as set forth in claim 13, wherein said door shaft is a torsion spring shaft having a slot along its length.

15. A shaft operator assembly for moving a door having movable door leaf and a door shaft attached to said door leaf for common movement together, said shaft operator assembly comprising a shaft connecting means for connecting a driven member of said shaft operator assembly to said door shaft, wherein said shaft connecting means comprises a connecting plate element secured to said driven member and a shaft connecting element mountable non-rotatably on said door shaft, said shaft connecting element including an axial opening extending through said shaft connecting element for receiving non-rotatably said door shaft and including a plate connecting portion located radially outside of said opening and mounted to said connecting plate element;

said connecting plate element is secured non-rotatably and braced to said driven member by a coupler;

wherein said coupler comprises a flanged portion for engaging said connecting plate element in a non-rotatably but axially movable manner;

wherein an outer contour of said flanged portion of said coupler has a modified hexagonal shape four sides of which comprise flats located by their centerpoints equi-spaced radially from a longitudinal centerline of said coupler, a fifth side of said modified hexagonal shape being configured nearer to said longitudinal centerline than the four flats and longer than each one of the four flats, and a sixth side of said modified hexagonal shape being adapted to engage said door shaft.

16. The shaft operator assembly as set forth in claim 15, wherein said shaft connecting element and said connecting plate element are secured to each other by cap screws.

17. The shaft operator assembly as set forth in claim 15, wherein said connecting plate element is clasped to said driven member by said coupler and includes a receiving recess in a side opposite said driven member for facing toward said door shaft in which said flanged portion of said coupler is fully receivable.

18. The shaft operator assembly as set forth in claim 17, wherein the outer contour of said flanged portion of said coupler is axially insertable non-rotatably into said axial opening of said shaft connecting element.

* * * * *